US011958107B2

(12) United States Patent
Hartley et al.

(10) Patent No.: US 11,958,107 B2
(45) Date of Patent: Apr. 16, 2024

(54) TUNDISH FUNNEL

(71) Applicant: AK Steel Properties, Inc., West Chester, OH (US)

(72) Inventors: Michael Ryan Hartley, Mansfield, OH (US); Ken Morales Higa, West Chester, OH (US)

(73) Assignee: Cleveland-Cliffs Steel Properties Inc., West Chester, OH (US)

( * ) Notice: Subject to any disclaimer, the term of this patent is extended or adjusted under 35 U.S.C. 154(b) by 468 days.

(21) Appl. No.: 15/672,387

(22) Filed: Aug. 9, 2017

(65) Prior Publication Data

US 2018/0043429 A1 Feb. 15, 2018

Related U.S. Application Data

(60) Provisional application No. 62/372,431, filed on Aug. 9, 2016.

(51) Int. Cl.

| | |
|---|---|
| ***B22D 41/54*** | (2006.01) |
| ***B22D 11/103*** | (2006.01) |
| ***B22D 11/106*** | (2006.01) |
| ***B22D 37/00*** | (2006.01) |
| ***B22D 41/50*** | (2006.01) |
| ***B22D 41/56*** | (2006.01) |

(52) U.S. Cl.

CPC ..... *B22D 41/54* (2013.01); *B22D 11/103* (2013.01); *B22D 11/106* (2013.01); *B22D 37/005* (2013.01); *B22D 41/50* (2013.01); *B22D 41/505* (2013.01); *B22D 41/56* (2013.01)

(58) Field of Classification Search

CPC ..... B22D 11/10; B22D 11/103; B22D 11/106; B22D 41/50; B22D 41/502; B22D 41/505; B22D 41/507

See application file for complete search history.

(56) References Cited

U.S. PATENT DOCUMENTS

| | | | | |
|---|---|---|---|---|
| 3,091,265 A * | 5/1963 | Ulstad | ..... | B22D 18/06 141/383 |
| 3,749,387 A * | 7/1973 | Andrzejak | ..... | B22D 41/24 222/512 |
| 4,393,985 A | 7/1983 | Muller et al. | | |

(Continued)

FOREIGN PATENT DOCUMENTS

| | | | | |
|---|---|---|---|---|
| AT | 346512 B | 11/1978 | | |
| CA | 1064675 A * | 10/1979 | ..... | B22D 41/50 |

(Continued)

OTHER PUBLICATIONS

International Search Report and Written Opinion dated Mar. 29, 2018 for Application No. PCT/US2017/046117, 15 pages.

(Continued)

*Primary Examiner* — Kevin P Kerns
*Assistant Examiner* — Jacky Yuen
(74) *Attorney, Agent, or Firm* — Frost Brown Todd LLP

(57) ABSTRACT

A continuous casting machine is provided that includes a refractory tundish funnel. The tundish funnel has a tapered shape and is designed to sit on a tundish lid in order to channel steel from the ladle to the tundish bath. A collector can also be provided to channel the steel from the ladle. The collector has an opening with a cross-section that transitions from a cylindrical shape to a cross-shape.

12 Claims, 10 Drawing Sheets

(56) References Cited

U.S. PATENT DOCUMENTS

| | | | | | |
|---|---|---|---|---|---|
| 4,415,103 | A * | 11/1983 | Shapland | B22D 41/24 222/590 |
| 4,615,471 | A * | 10/1986 | Schurmeier | B22D 41/28 222/598 |
| 4,792,070 | A | 12/1988 | Daussan et al. | |
| 5,072,689 | A | 12/1991 | Nakagawa et al. | |
| 5,131,573 | A * | 7/1992 | Tommaney | B22D 11/106 222/590 |
| 5,173,198 | A * | 12/1992 | Blum | B22D 41/50 222/600 |
| 8,127,972 | B2 * | 3/2012 | Hanse | B22D 41/28 222/606 |
| 2004/0100002 | A1 * | 5/2004 | Richaud | B22D 41/18 266/266 |

FOREIGN PATENT DOCUMENTS

| | | | |
|---|---|---|---|
| CN | 1970194 | A | 5/2007 |
| CN | 1986113 | A | 6/2007 |
| CN | 104117666 | A | 10/2014 |
| CN | 104759612 | | 7/2015 |
| CN | 204584255 | U | 8/2015 |
| JP | S52-009630 | | 1/1977 |
| JP | S53-149825 | | 12/1978 |
| JP | S57-165167 | | 10/1982 |
| JP | S62-040959 | | 2/1987 |
| JP | H01-048663 | | 10/1989 |
| JP | H05-023808 | | 2/1993 |
| JP | 2005-254245 | | 9/2005 |
| JP | 2007-044731 | | 2/2007 |
| JP | 2010-064124 | | 3/2010 |
| KR | 1999-0006346 | | 2/1999 |
| TW | 371631 | B | 10/1999 |
| TW | 515783 | B | 1/2003 |
| TW | 201515736 | A | 5/2015 |
| TW | 201540392 | A | 11/2015 |

OTHER PUBLICATIONS

Taiwanese Office Action dated Feb. 27, 2018 for Application No. 106126955, 15 pgs.

"Weitere Moeglichkeiten des Giessens Metallurgisch Hochwertiger Gussstuecke," Giesserei, vol. 75, No. 17, Aug. 15, 1988, p. 497. Dusseldorf, West Germany. XP-002058276.

* cited by examiner

TUNDISH FUNNEL

PRIORITY

This application claims priority to U.S. Provisional Application Ser. No. 62/372,431, entitled TUNDISH FUNNEL, filed on Aug. 9, 2016, the disclosure of which is incorporated by reference herein.

BACKGROUND

Continuous casting can be used in steelmaking to produce semi-finished steel shapes such as ingots, slabs, blooms, billets, etc. During a typical continuous casting process, liquid steel is transferred to a ladle, where it flows from the ladle, through a tundish, and into a mold. The tundish is a large container that holds a reservoir of the liquid steel to distribute to the mold in a continuous flow.

In some instances, oxygen formed within the liquid steel can produce defects, such as pinholes, within the steel. To reduce the occurrence of such defects, the liquid steel is deoxidized, or killed, and a refractory ladle shroud is generally inserted into the tundish from the ladle during the continuous casting process to shroud the liquid steel as it flows from the ladle to the tundish. Such ladle shrouds can be costly and difficult to sufficiently seal with the tundish, which can cause re-oxidation of the liquid steel and produce defects. As such, there is a need to provide an apparatus with an improved seal between the ladle and the tundish at a lower cost.

Moreover, to maintain the amount of liquid steel in the tundish in a desirable range, more than one ladle can be exchanged during the continuous casting process to pour the liquid steel into the tundish. This ladle exchange process can be inefficient by having to wait to perform the ladle exchange until the level of the liquid steel decreases to an acceptable level within the tundish. Further, because the ladle shroud is typically attached to the ladle, it can be difficult to remove the ladle shroud from the tundish during the ladle exchange. As such, there is also a need to provide an apparatus that provides a more efficient and easier ladle exchange.

SUMMARY

A tundish funnel is provided to address the aforementioned needs to achieve an improved continuous casting process. This refractory piece is tapered to channel the liquid steel from the ladle to the tundish. A collector can also be provided to improve the flow properties of the liquid steel as it is transferred from the ladle to the tundish.

DESCRIPTION OF FIGURES

It is believed that the present invention will be better understood from the following description of certain examples taken in conjunction with the accompanying drawings, in which like reference numerals identify like elements.

Figure 1:
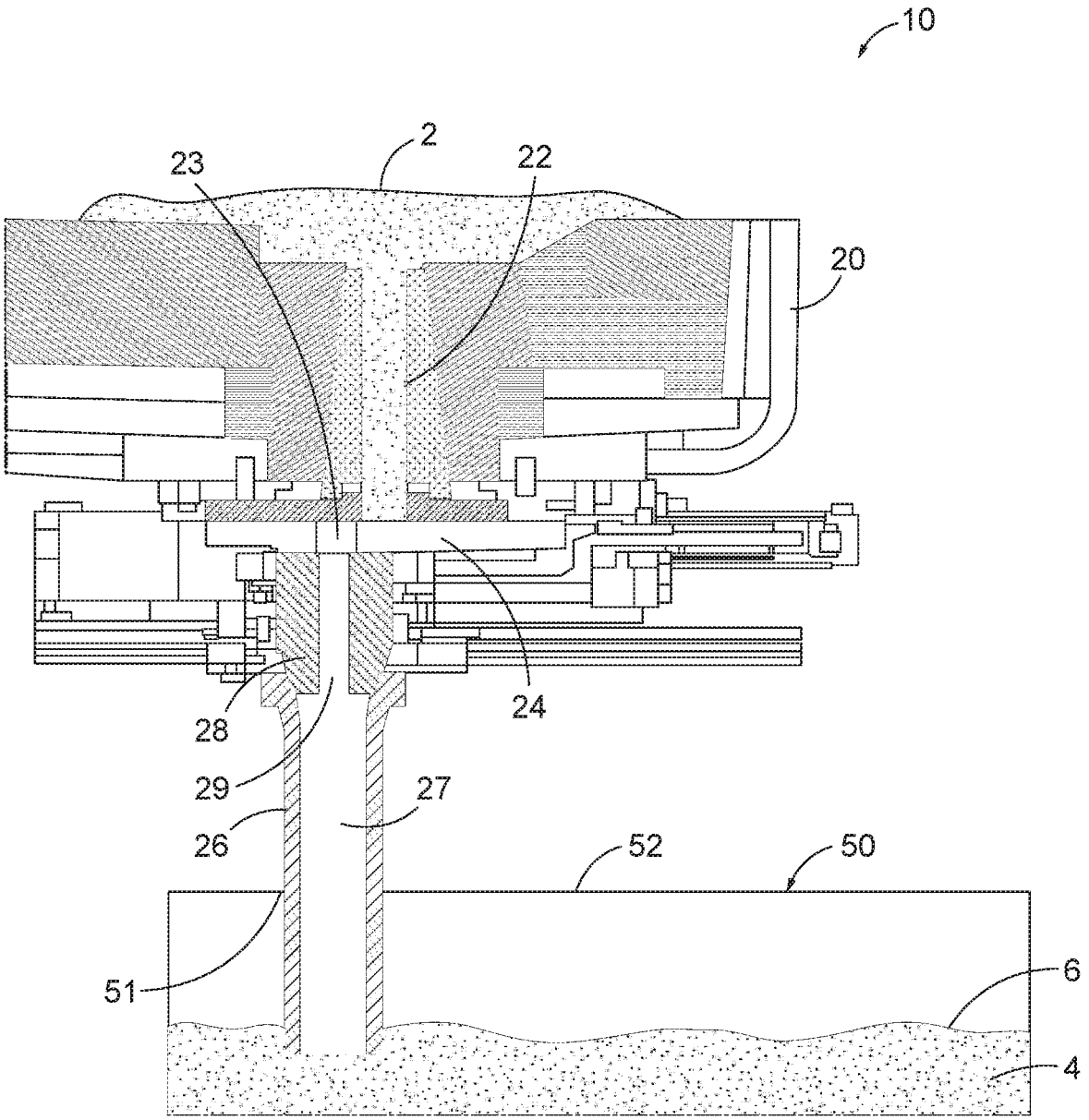
FIG. 1 depicts a partial cross-sectional view of a continuous casting machine having a ladle coupled to a tundish by a ladle shroud.

The drawings are not intended to be limiting in any way, and it is contemplated that various embodiments of the present disclosure may be carried out in a variety of other ways, including those not necessarily depicted in the drawings. The accompanying drawings incorporated in and forming a part of the specification illustrate several aspects of the present disclosure, and together with the descriptions serve to explain the principles and concepts of the present disclosure; it being understood, however, that the present disclosure is not limited to the precise arrangements shown.

DETAILED DESCRIPTION

The following description and embodiments of the present disclosure should not be used to limit the scope of the present disclosure. Other examples, features, aspects, embodiments, and advantages of the present disclosure will become apparent to those skilled in the art from the following description. As will be realized, the present disclosure may contemplate alternate embodiments than those exemplary embodiments specifically discussed herein without departing from the scope of the present disclosure. Accordingly, the drawings and descriptions should be regarded as illustrative in nature and not restrictive.

FIG. 1 shows a typical continuous casting machine (10) having a ladle (20) coupled to a tundish (50) by a ladle shroud (26). As shown, liquid steel (2) stored within the ladle (20) flows through a ladle nozzle (22) to a slide gate (24). The slide gate (24) can be opened and closed by selectively aligning an opening (23) of the slide gate (24) with the ladle nozzle (22) to control the amount of liquid steel (2) that flows from the ladle (20). The slide gate (24) is then coupled with the ladle shroud (26) via a bore connector (28). The bore connector (28) defines a central opening (29) having a substantially constant inner diameter. This central opening (29) aligns with a central opening (27) of the ladle shroud (26), which also has a substantially constant inner diameter. The opposing end of the ladle shroud (26) is then inserted through an opening (51) of the tundish lid (52) and within a steel bath (4) of the tundish (50). The liquid steel (2) thereby flows from the ladle nozzle (22) through the slide gate (24), the bore connector (28), and the ladle shroud (26) to the steel bath (4) of the tundish (50). The steel bath (4) is maintained at a level (6) above the end of the ladle shroud (26). The ladle shroud (26) is typically made from a standard alumina graphite material, which can be costly.

Because the ladle shroud (26) is coupled to the ladle (20), the ladle shroud (26) may not sufficiently seal the ladle (20) with the tundish (50) when it is inserted through the opening (51) of the tundish lid (52). This can cause re-oxidation of the liquid steel (2), which can thereby form defects within the steel. The substantially constant inner diameters of the bore connector (28) and/or the ladle shroud (26) can generate turbulence and/or skew the flow of the liquid steel (2). Such turbulence and/or skew can also form defects within the steel. Moreover, the ladle exchange process can be inefficient by having to wait to perform the ladle exchange until the level (6) of the steel bath (4) decreases to an acceptable level at the end of the ladle shroud (26) within the tundish (50). The ladle shroud (26) can also make it difficult to perform the ladle exchange because it is coupled with the ladle (20).

Accordingly, it may be desirable to improve the continuous casting machine (10) by forming a more complete seal between the ladle (20) and the tundish (50), reducing turbulence and/or skew within the liquid steel (2) as it flows from the ladle (20) to the tundish (50), decreasing the cost of the material, maintaining the steel bath (4) at a higher level (6), and/or providing an easier exchange of ladles (20). Such improvements are provided by the continuous casting machine (110) shown in FIG. 2. The continuous casting machine (110) is similar to the continuous casting machine of FIG. 1, except that a collector (130) is used instead of the bore connector (28) and a tundish funnel (140) is used instead of the ladle shroud (26). It should be noted that the collector (130) and the tundish funnel (140) can be used individually and/or in combination with each other to provide the above-mentioned improvements to the continuous casting machine (110).

Figure 3:
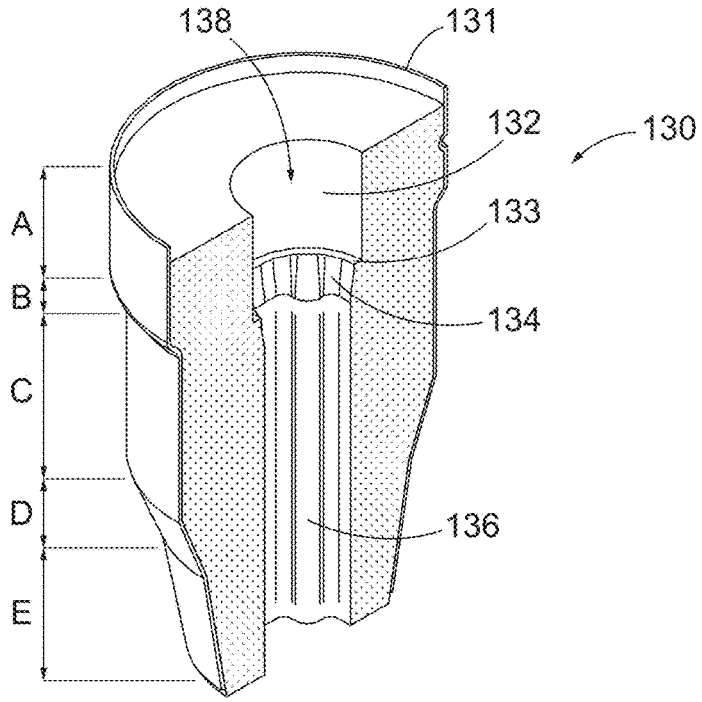
FIG. 3 depicts a top perspective cross-sectional view of a collector of the continuous casting machine of FIG. 2.
Figure 4:
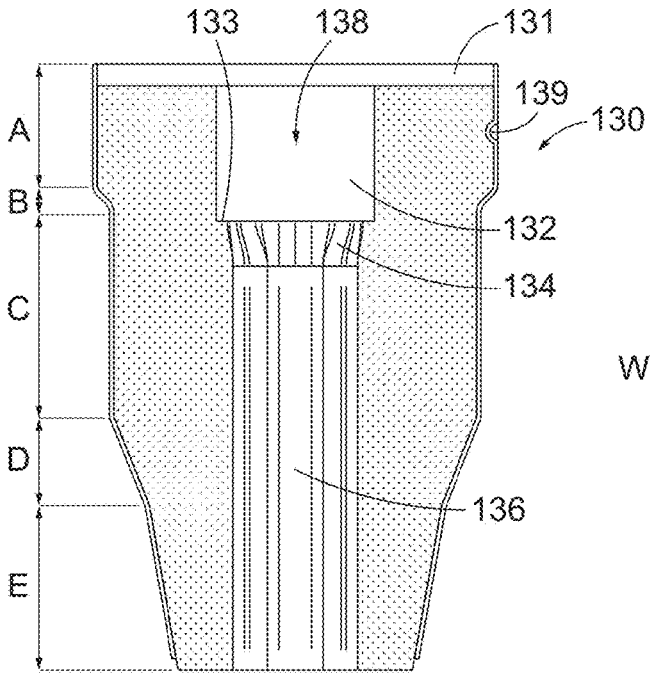
FIG. 4 depicts a cross-sectional view of the collector of FIG. 3.
Figure 5:
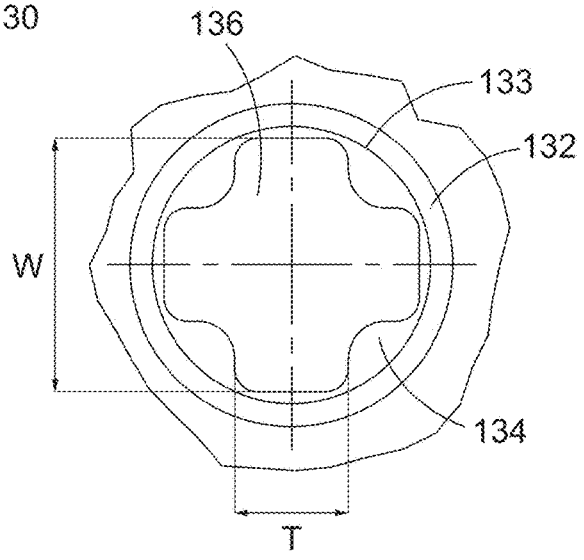
FIG. 5 depicts a partial top plan view of the collector of FIG. 3.

The collector (130) is shown in more detail in FIGS. 3-5. In the illustrated embodiment, the collector (130) comprises a wide cylindrical portion (A) adjacent to a first tapered portion (B) to form an intermediate cylindrical portion (C) adjacent to a second tapered portion (D), which is adjacent to a third tapered portion (E). As such, the outer diameter of the collector (130) narrows from a top end of the collector (130) to a bottom end of the collector (130). The outer wall of the wide cylindrical portion (A) may have a diameter of about 180 mm and a length of about 56 mm. The first tapered portion (B) may narrow the diameter of the outer wall of the collector (130) to about 165 mm at an angle of about 45 degrees to the intermediate cylindrical portion (C). The outer wall of the intermediate cylindrical portion (C) may then have a length of about 90 mm. The second tapered portion (D) may narrow the diameter of the outer wall of the collector to about 133.5 mm at an angle of about 20 degrees. The third tapered portion (E) may then narrow the diameter of the outer wall of the collector to about 110 mm at an angle of about 10 degrees.

The collector (130) further defines an opening (138) through a central portion of the collector (130). As best seen in FIG. 4, the opening (138) comprises a cylindrical opening (132) at a top portion of the collector (130). The cylindrical opening (132) may have a diameter of about 70 mm and a length of about 60 mm. The bottom of the cylindrical opening (132) abuts a shelf (133). The shelf (133) may have an inner diameter of about 60 mm. The shelf (133) is adjacent to a transitional opening (134) that transitions from a cylindrical opening at the top of the opening (134) to a cross-shaped opening at the bottom of the opening. The transitional opening (134) is tapered such that the cross-shaped opening has a smaller diameter than the cylindrical opening. The transitional opening (134) may have a length of about 20 mm. The transitional opening (134) is adjacent to a cross-shaped opening (136) that extends through the bottom portion of the collector (130) and may have a length of about 180 mm. The width (W) from each end of the cross portion of the opening (134) may be about 55 mm and the thickness (T) of each cross portion of the opening may be about 24.5 mm. In the illustrated embodiment, the cross-shaped opening (136) comprises rounded corners. The collector (130) may be made from any suitable standard castable material. Still other suitable dimensions and configurations for the collector (130) will be apparent to one with ordinary skill in the art in view of the teachings herein.

Figure 14:
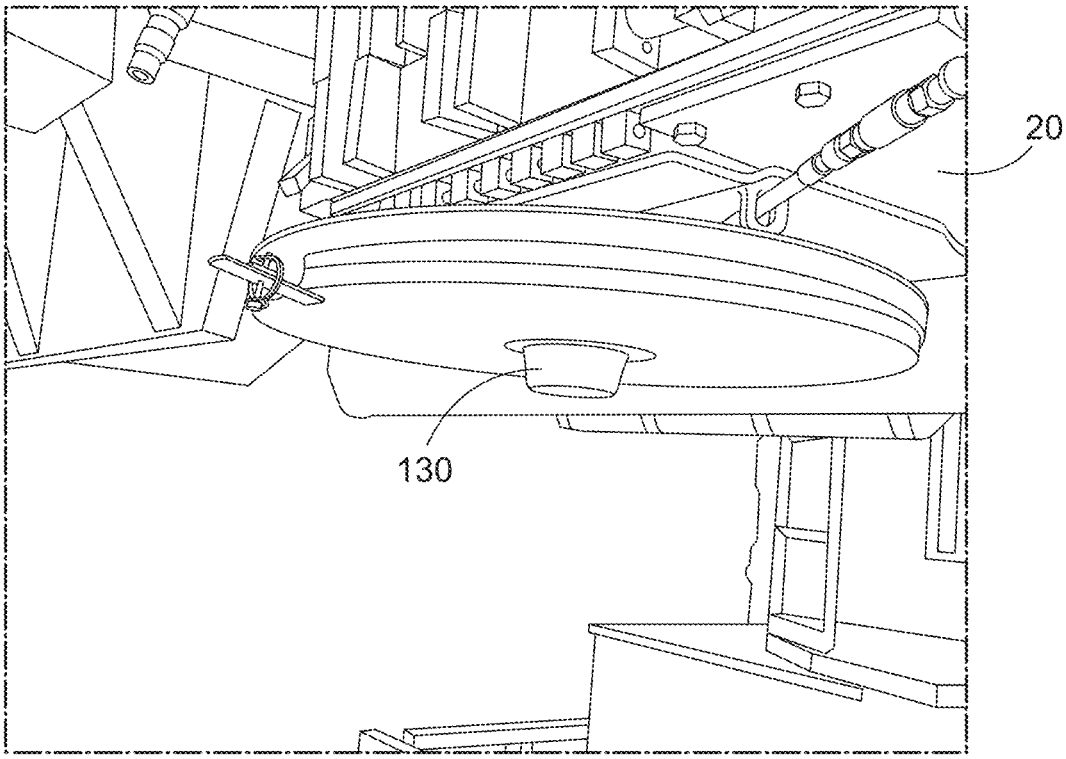
FIG. 14 depicts a bottom perspective view of the collector coupled with the ladle of the continuous casting machine of FIG. 2.

Referring back to FIG. 2, the collector (130) is attached to the slide gate (24) of the continuous casting machine (110) with rim (131) of the collector (130) such that opening (138) of the collector (130) is aligned with the opening (23) of the slide gate (24) when the slide gate (24) is in the open position. In the illustrated embodiment, the cylindrical opening (132) of the collector (130) has a wider diameter than the opening (23) of the slide gate (24) to allow for some error in aligning the slide gate (24) with the collector (130). The collector (130) may be aligned and held with the slide gate (24) via a bayonet fitting and an indentation (139) on a side wall the of the collector (130). Other suitable configurations for coupling the collector (130) with the slide gate (24) will be apparent to one with ordinary skill in the art in view of the teachings herein. The bottom portion of the collector extends below the ladle (20) assembly, as shown in FIG. 14, which can then be fluidly coupled with a tundish funnel (140) or a ladle shroud (26) to direct flow of the liquid steel (2) from the ladle (20) to the tundish (50). The cross-sectional shape of the opening (138) and/or the abrupt narrowing of the opening (138) help to reduce turbulence and/or reduce skewing within the flow of the liquid steel (2) to thereby reduce and/or prevent defects within the molded steel. The collector (130) may also prevent liquid steel (2) from building up within the funnel (140).

Figure 6:
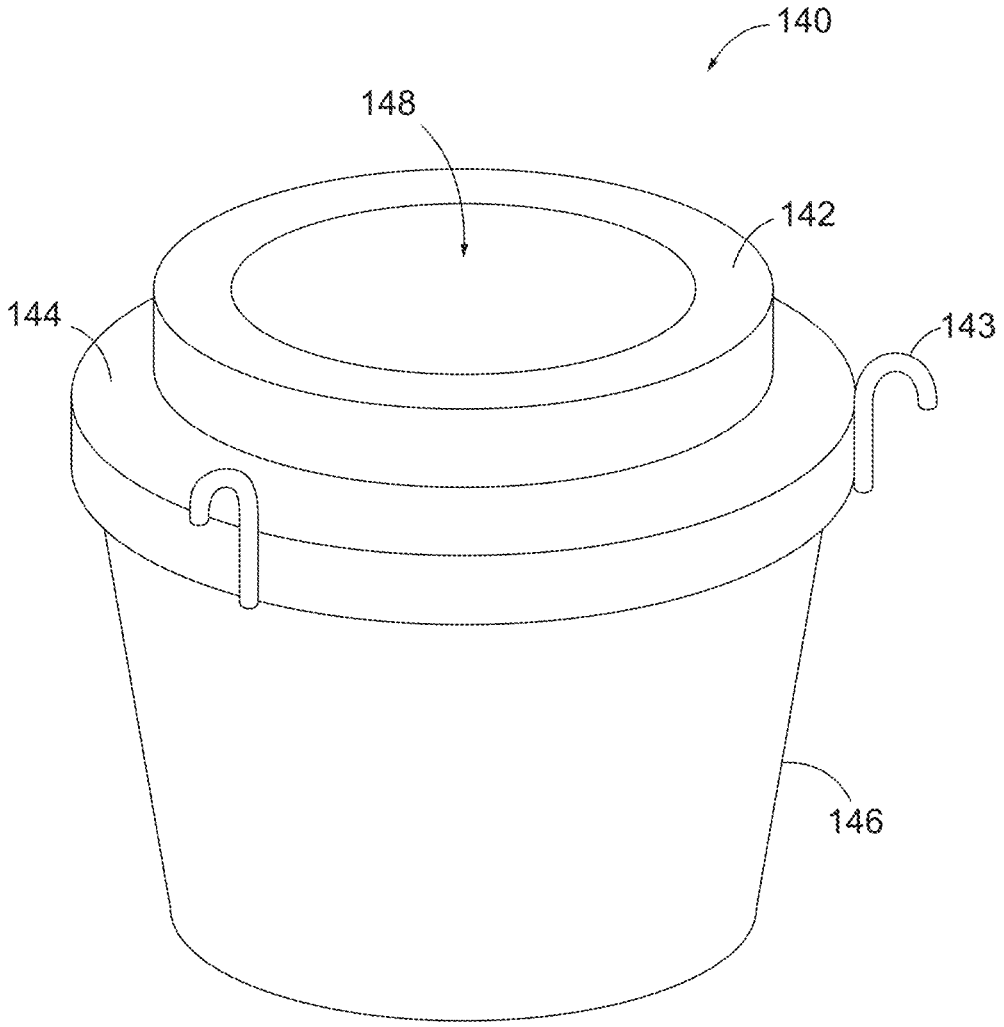
FIG. 6 depicts a top perspective view of the tundish funnel of FIG. 2.
Figure 7:
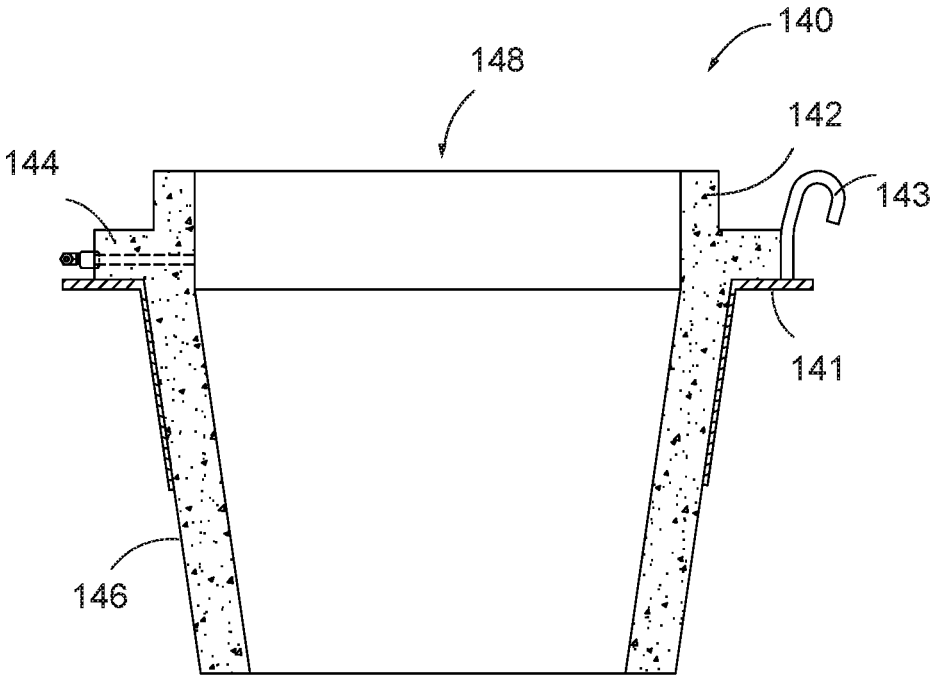
FIG. 7 depicts a cross-sectional view of the tundish funnel of FIG. 2.
Figure 8:
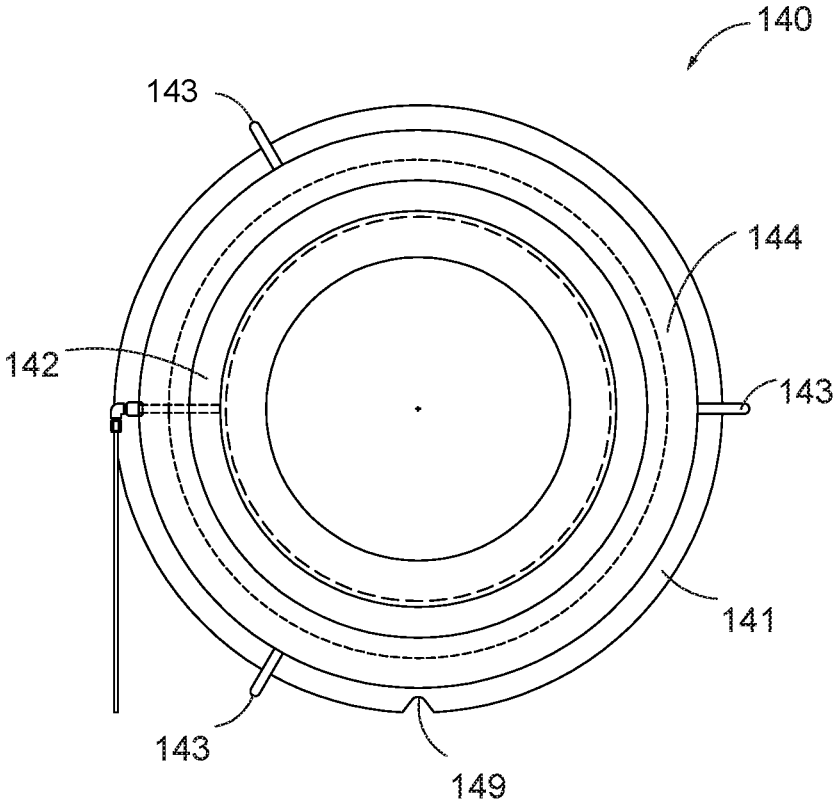
FIG. 8 depicts a top plan view of the tundish funnel of FIG. 2.

FIGS. 6-8 show the tundish funnel (140) in more detail. The tundish funnel (140) comprises a top rim (142) extending above an annular flange (144), tapered portion (146) extending below the annular flange (144), and an opening (148) that extends therethrough. The tundish funnel (140) comprises a cylindrical cross-sectional shape that narrows from a top portion of the funnel (140) to a bottom portion of the funnel (140). In the illustrated embodiment, the rim (142) has an inner diameter of about 24⅝ inches, an outer diameter of about 28⅝ inches, and a length of about 3 inches. The annular flange (144) extends outwardly beyond the rim (142) and comprises an outer diameter of about 34¾ inches and a length of about 3 inches. The inner diameter of the funnel (140) at the annular flange (144) is maintained from the rim (142). The tapered portion (146) then extends below the annular flange (144) at a length of about 19½ inches. The inner diameter of the funnel (140) narrows to about 19 inches along the length of the tapered portion (146) and the outer diameter of the funnel (140) narrows from about 30 3/16 inches to about 26 1/16 inches along the length of the tapered portion (146). The funnel (140) may be made from a cast-able $Al_2O_3/SiO_2$ material, or any other suitable material. Such a funnel (140) provides a lower cost than a typical ladle shroud because the funnel (140) of the present embodiment is shorter to thereby include less material, and such $Al_2O_3/SiO_2$ material has a lower cost than the typical alumina graphite material generally used to make a ladle shroud. Still other suitable configurations and/or dimensions for the funnel (140) will be apparent to one with ordinary skill in the art in view of the teachings herein.

Figure 2:
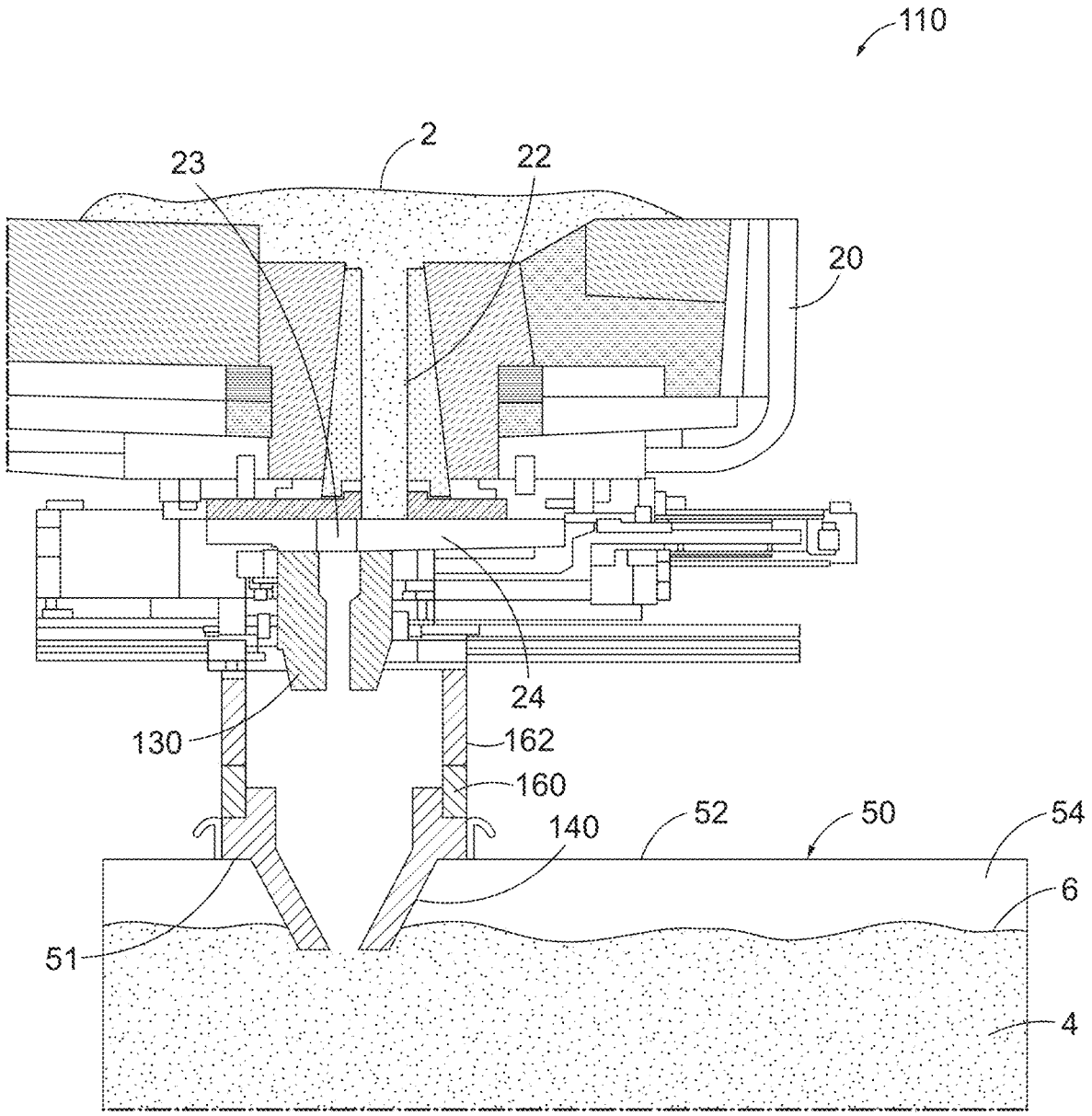
FIG. 2 depicts a partial cross-sectional view of another continuous casting machine having a ladle coupled to a tundish by a tundish funnel.
Figure 9:
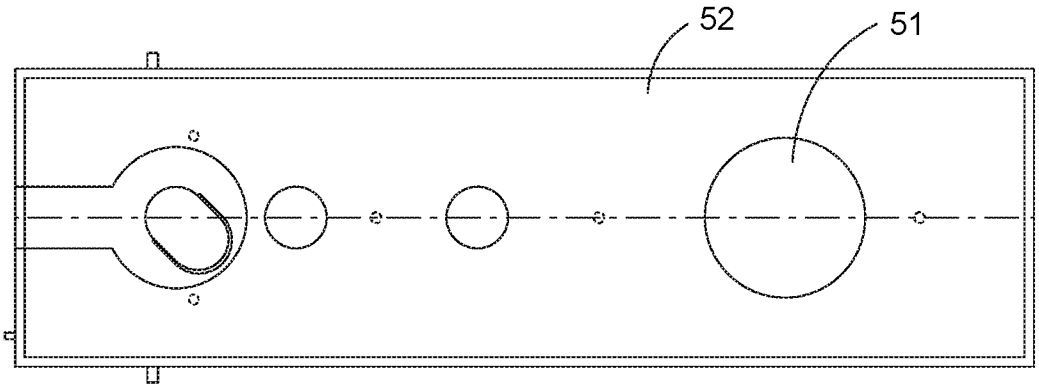
FIG. 9 depicts a top plan view of a tundish lid of the continuous casting machine of FIG. 2.
Figure 10:
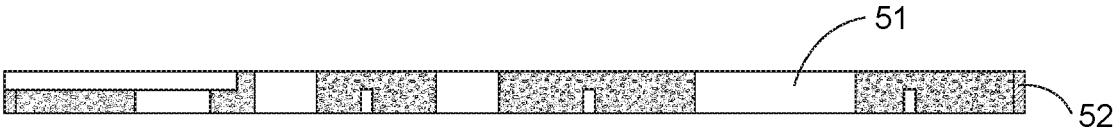
FIG. 10 depicts a cross-sectional view of the tundish lid of FIG. 9.
Figure 11:
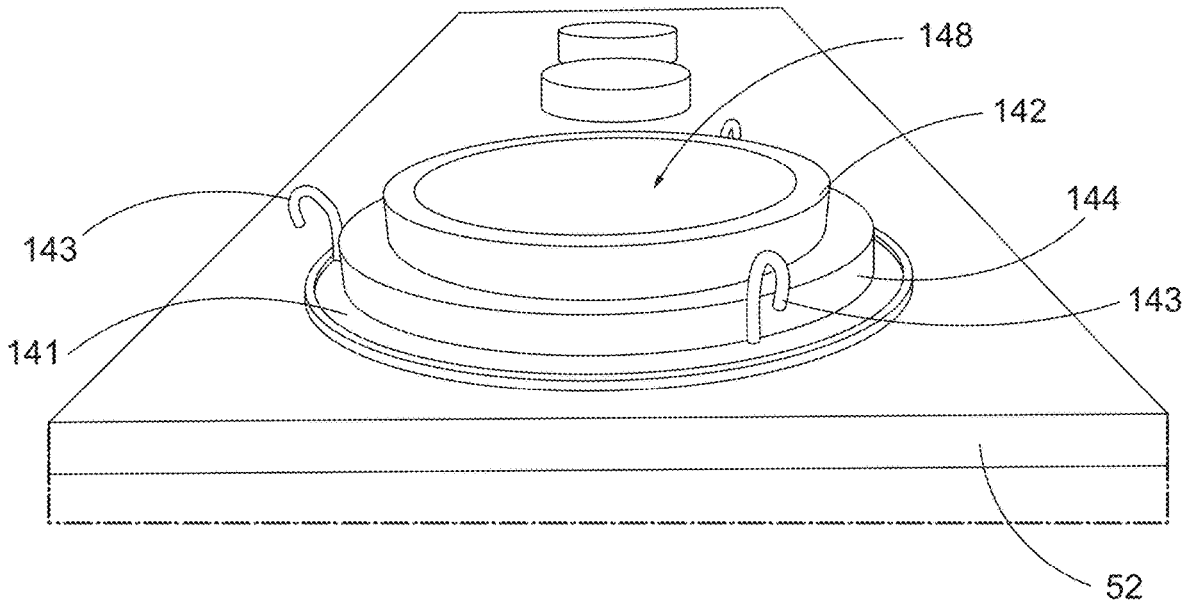
FIG. 11 depicts a top perspective view of the tundish funnel inserted within the tundish lid of the continuous casting machine of FIG. 2.

The tundish funnel (140) can thereby be attached to a tundish lid (52) to direct flow of the liquid steel (2) from the ladle (20) to the tundish (50). As shown in FIGS. 6-8, the tundish funnel (140) of the illustrated embodiment comprises one or more hooks (143) positioned along the annular flange (144). These hooks (143) extend upwardly and outwardly from the flange (144) such that the funnel (140) can be held by a piece of machinery by the hooks (143) to lift and place the funnel (140) on the tundish lid (52). Also in the illustrated embodiment, a metal ring (141) is positioned underneath the annular flange (144) and extends about halfway down the tapered portion (146) to provide further support for the funnel (140). Accordingly, the funnel (140) can be positioned within an opening (51) of a tundish lid (52) such that the metal ring (141) and the annular flange (144) rest on top of the tundish lid (52), as shown in FIGS. 9-11. The tapered portion (146) is thereby positioned within the tundish (50) such that the bottom end of the tapered portion (146) rests within the steel bath (4) of the tundish (50) (FIG. 2). Because the funnel (140) is positioned on the tundish lid (52) instead of the ladle (20), the funnel (140) is able to provide a better seal between the ladle (20) and the tundish (50) to thereby reduce and/or prevent re-oxidation of the steel (2) and/or prevent tundish flux from being pushed into the steel bath (4). Of course, other suitable configurations for attaching the funnel (140) with the tundish (50) will be apparent to one with ordinary skill in the art in view of the teachings herein.

The rim (142) of the tundish funnel (140) can be coupled with the collector (130) or a bore connector (28). For instance, the funnel (140) can be aligned and fluidly coupled with the ladle (20) via a bayonet fitting and indentation (149) located on the annular flange (144). Referring back to FIG. 2, the rim (142) is coupled with the collector (130) such that the opening (148) of the funnel (140) is aligned with the opening (138) of the collector (130). In the illustrated embodiment, the diameter of the rim (142) of the funnel (140) is wider than the diameter of the bottom portion of the collector (130). This allows for some pouring error when aligning the collector (130) with the funnel (140) during the casting process. The tundish funnel (140) thereby provides a seal for the liquid steel (2) flowing from the collector (130) to the tundish (50). The funnel shape of the tundish funnel (140) may further reduce turbulence within the flow of the liquid steel (2) during casting.

Figure 12:
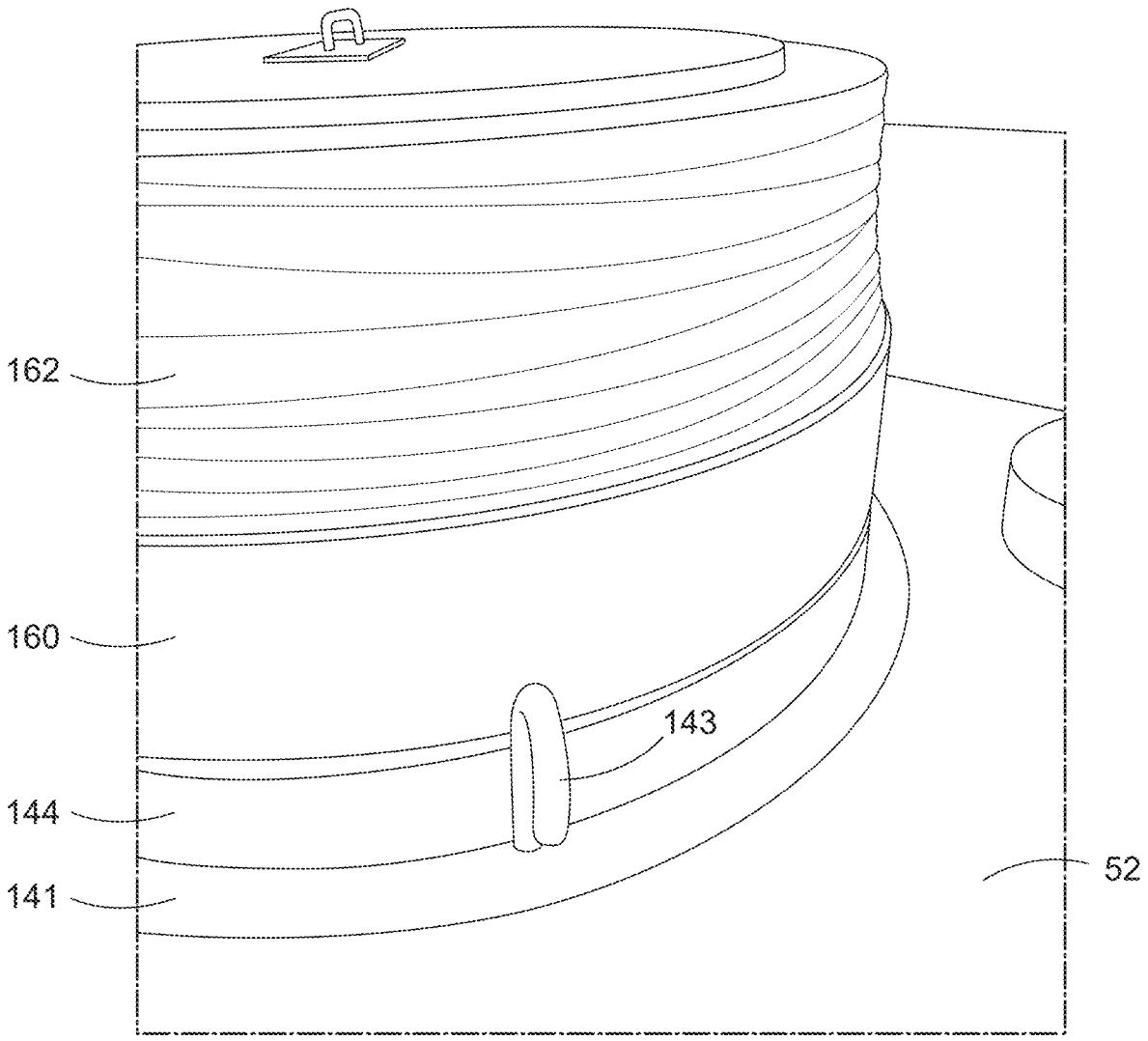
FIG. 12 depicts a top perspective view of the tundish funnel of FIG. 11 with a metal ring and a cable ring positioned above the tundish funnel.
Figure 13:
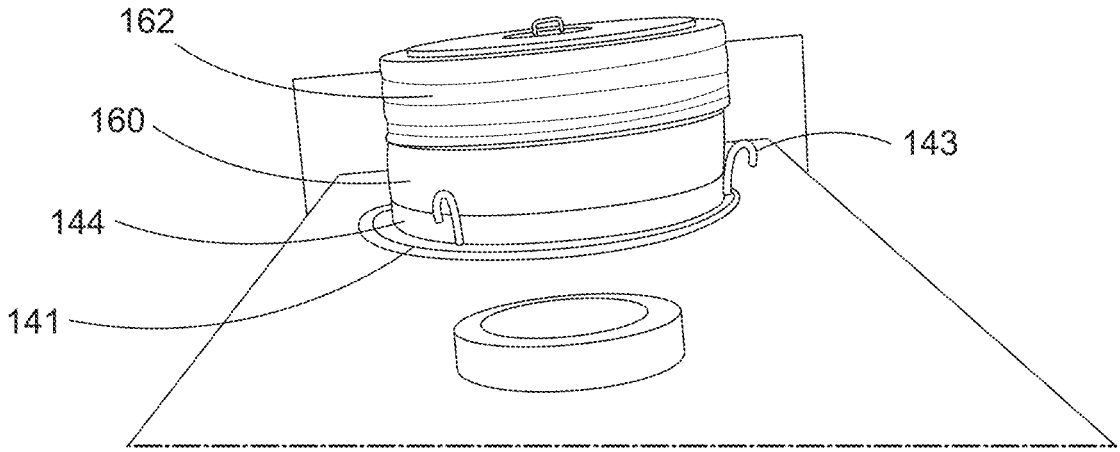
FIG. 13 depicts a top perspective view of the tundish funnel of FIG. 12.

Further, as shown in FIGS. 2 and 12-13, a first ring (160) and a second ring (162) can be placed between the funnel (140) and the collector (130). In the illustrated embodiment, the first ring (160) is positioned around the rim (142) of the funnel such that the bottom of the first ring (160) abuts the annular flange (144). The first ring (160) then extends upwardly above the rim (142) of the funnel (140). The first ring (160) may comprise a sufficiently rigid material. The second ring (162) is then positioned above the first ring (160) and extends to the ladle (20) around the collector (130). The second ring (162) may comprise a crushed cable, or any other suitable material, that is sufficiently resilient such that the second ring (162) compresses when the ladle (20) is lowered onto the funnel (140). Such rings (160, 162) may provide a better seal between the tundish funnel (140) and the collector (130), but such rings (160, 162) are merely optional. Still other configurations for coupling the funnel (140) with the ladle (20) will be apparent to one with ordinary skill in the art in view of the teachings herein.

Accordingly, as shown in FIG. 2, the collector (130) is coupled with and aligned with the slide gate (24) of the ladle (20). The tundish funnel (140) is then fluidly coupled with and aligned with the collector (130). The funnel (140) is then coupled with the tundish lid (52) such that the bottom portion of the funnel (140) is inserted within the steel bath (4) of the tundish (50). The liquid steel (2) thereby flows from the ladle (20), through the collector (130) and the tundish funnel (140), to the tundish (50). The collector (130) and/or the tundish funnel (140) work to reduce turbulence within the flow of the liquid steel (2) and/or provide a better seal between the ladle (20) and the tundish (50) to reduce and/or prevent re-oxidation of the liquid steel (2). This may thereby reduce and/or prevent defects from occurring within the resulting molded steel.

The tundish funnel (140) further allows for a more efficient and easier ladle exchange. For instance, because the tundish funnel (140) is shorter in length, the funnel (140) allows the steel bath (4) within the tundish (50) to be maintained at a higher level (6) while keeping the bottom end of the funnel (140) submerged within the steel bath (4). For instance, the steel bath (4) can be maintained at about 20 tons during a ladle exchange with the tundish funnel (140), instead of about 18 tons. Because the steel bath (4) can be maintained at a higher level (6), the ladle exchange process does not have to wait for the steel bath (4) to decrease as much. The ladle exchange process can thereby occur sooner, at a higher steel bath level (6), to make the ladle exchange process more efficient. Also, because the tundish funnel (140) is attached to the tundish lid (52) instead of the ladle (20), the process for removing the ladle (20) and aligning a new ladle (20) with the tundish (50) is easier.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A continuous casting machine comprising:

(a) a ladle;

(b) a collector extending through the ladle such that a bottom portion of the collector is disposed below the ladle, wherein the collector comprises a collector opening extending therethrough, wherein a top portion of the collector opening comprises a cylindrical cross-section adjacent to a shelf, wherein an intermediate portion of the collector opening comprises a transitional opening that tapers from the shelf to a bottom portion of the collector opening comprising a cross-shaped cross-section;

(c) a tundish funnel positioned underneath the collector, wherein the tundish funnel comprises an opening extending therethrough, wherein a top portion of the opening comprises a larger diameter than a bottom portion of the opening such that the opening is tapered;

(d) a coupling comprising at least one ring extending from the tundish funnel to the ladle such that a top surface of the at least one ring is positioned against a bottom surface of the ladle, wherein the coupling is positioned about a bottom portion of the collector such that the bottom portion of the collector extends within the coupling to space an inner surface of the coupling away from an outer surface of the collector to fluidly seal the collector with the tundish funnel; and (e) a tundish, wherein the tundish funnel is coupled to a lid of the tundish such that the tundish funnel extends through the tundish lid and into the tundish.

2. The continuous casting machine of claim 1, wherein the tundish funnel is operable to seal the tundish with the ladle.

3. The continuous casting machine of claim 1, wherein a diameter of the top portion of the opening of the tundish funnel is larger than a diameter of the cross-shaped cross-section of the collector opening.

4. The continuous casting machine of claim 1, wherein a compressible ring is positioned between the tundish funnel and the ladle.

5. The continuous casting machine of claim 1, wherein the ladle comprises a slide gate having an opening, wherein the slide gate is movable to selectively align the opening of the slide gate with a ladle nozzle, wherein the collector is coupled with the slide gate such that the collector opening is aligned with the opening of the slide gate.

6. The continuous casting machine of claim 5, wherein the top portion of the collector opening comprises a larger diameter than the opening of the slide gate.

7. The continuous casting machine of claim 1, wherein the cross-shaped cross-section comprises rounded corners.

8. The continuous casting machine of claim 1, wherein an outer surface of the collector narrows from a top end of the collector to a bottom end of the collector.

9. The continuous casting machine of claim 8, wherein the outer surface of the collector narrows at an angle from about 10 degrees to about 45 degrees.

10. The continuous casting machine of claim 8, wherein a first portion of the outer surface of the collector narrows at a first angle and a second portion of the outer surface of the collector narrows at a second angle that is different than the first angle.

11. The continuous casting machine of claim 1, wherein the opening of the tundish funnel comprises a first portion that is substantially cylindrical and a second portion positioned below the first portion that is tapered to narrow to a bottom end of the tundish funnel.

12. A continuous casting machine comprising:

(a) a ladle;

(b) a collector coupled to a bottom portion of the ladle, wherein the collector comprises a collector opening extending therethrough;

(c) a tundish funnel positioned underneath the collector, wherein the tundish funnel comprises first opening extending therethrough, wherein a first ring is positioned about the tundish funnel, wherein the first ring is rigid, wherein a second ring is positioned above and adjacent to the first ring and extends to a bottom portion of the ladle about the collector, wherein a second opening is formed through the first and second rings such that an inner diameter of the second opening is continuous through the first and second rings, wherein the second ring is resilient such that the second ring is configured to compress when the ladle is lowered onto the second ring; and (d) a tundish, wherein the tundish funnel is coupled to a lid of the tundish such that the tundish funnel extends through the tundish lid and into the tundish.

* * * * *